US006653544B1

(12) United States Patent
Cho et al.

(10) Patent No.: US 6,653,544 B1
(45) Date of Patent: Nov. 25, 2003

(54) PLAYING SOUND GENERATING APPARATUS AND METHOD USING SOUND GENERATION OF IMAGE DISPLAY DEVICE

(75) Inventors: Su-Duk Cho, Daeku (KR); Jae-Kyung Lee, Daeku (KR)

(73) Assignee: LG Electronics (KR)

( * ) Notice: Subject to any disclaimer, the term of this patent is extended or adjusted under 35 U.S.C. 154(b) by 0 days.

(21) Appl. No.: 09/300,264

(22) Filed: Apr. 27, 1999

(51) Int. Cl.[7] ..... G04B 13/00; G10H 7/00
(52) U.S. Cl. ..... 84/609; 84/604; 84/649
(58) Field of Search ..... 84/600–609, 622–625, 84/649, 659–660

(56) References Cited

U.S. PATENT DOCUMENTS 5,095,798 A * 3/1992 Okada et al. ..... 84/609
5,768,127 A * 6/1998 Murata ..... 84/602
5,804,749 A * 9/1998 Shirakawa et al. ..... 84/601

FOREIGN PATENT DOCUMENTS

JP 634236 2/1988
JP 04326398 11/1992
JP 10091061 4/1998

* cited by examiner

*Primary Examiner*—Marlon T. Fletcher
(74) *Attorney, Agent, or Firm*—Ostrolenk, Faber, Gerb & Soffen, LLP

(57) ABSTRACT

In an image display device such as a TV set, a playing sound generating method generates a sound without using a separate sound source integrating device and also generates a playing sound using the generated sound. To achieve the method, there is provided a playing sound generating apparatus which includes: a key signal input unit setting various functions and having keys for inputting a scale to be generated; an input interface unit receiving and processing a key signal outputted from the key signal input unit; a unit sound data storing unit storing pulse generating data in order to generate specific unit sounds such as a scale; a control unit reading unit sound data stored in the unit sound data storing unit when a specific unit sound or playing sound generation requiring signal is inputted through the input interface unit and generating a sound signal of a square wave type in accordance with the unit sound data; a frequency divider dividing a referential oscillating signal outputted from an oscillator into a predetermined frequency; a timer outputting an interrupt signal to the control unit by counting an output signal of the oscillator after being set by the control unit with a value of the corresponding unit sound data; and an output interface unit externally outputting the sound signal generated from the control unit.

9 Claims, 15 Drawing Sheets

| SCALE | | FREQUENCY |
|---|---|---|
| DO | C | 261.63Hz |
| RE | D | 293.67Hz |
| MI | E | 329.63Hz |
| FA | F | 349.23Hz |
| SOL | G | 392.00Hz |
| LA | A | 440.00Hz |
| SI | B | 493.88Hz |
| DO | C | 523.23Hz |
| RE | D | 587.34Hz |
| MI | E | 659.25Hz |
| FA | F | 698.45Hz |
| SOL | G | 783.98Hz |
| LA | A | 879.99Hz |
| SI | B | 987.75Hz |
| DO | C | 1046.50Hz |
| RE | D | 1174.70Hz |
| MI | E | 1318.60Hz |
| FA | F | 1397.10Hz |

PLAYING SOUND GENERATING APPARATUS AND METHOD USING SOUND GENERATION OF IMAGE DISPLAY DEVICE

BACKGROUND OF THE INVENTION

1. Field of the Invention

The present invention relates to a technique of generating sound and performing a playing function in an image display apparatus such as a television set, and more particularly to a playing sound generating apparatus and method for a TV set, which is capable of producing in various types a required unit sound using a timer and a microcomputer without applying a separate sound source integrating device and generating melody and playing sound while displaying a keyboard on-screen.

2. Description of the Conventional Art

Generally, a television set has a characteristic function of receiving and processing a broadcast from a broadcasting station and displaying a resultant video program on a screen or receiving and processing an image signal which is inputted via an external line or VCR by being reproduced and processed and displaying a resultant video program, and processing an audio signal which is inputted together with the video program and outputting the processed audio signal to a speaker.

However, a technique which of itself generates sounds in the television TV set is strongly required to provide various services besides the above characteristic functions. Thus, there have been proposed various apparatuses for generating sounds, but these apparatuses have to use an expensive sound source integrating device.

Since, in the conventional television set, there is only provided the characteristic function that receives, processes and displays a broadcast signal transmitted through aerial waves and displays a resultant program on a screen, or processes and displays the image signal which is inputted through the external line or VCR, it is impossible to provide various additional services for a user. As mentioned above, since no special function which generates sounds without additional cost is provided in the conventional television set, it is impossible to provide various sound services for the user. Further, there is no special service function such as a playing function that satisfies a user's various requirements and an expensive sound source integrating device must be provided when the playing function is added, which results in a decrease in cost competitiveness.

SUMMARY OF THE INVENTION

Accordingly, the present invention is directed to a playing sound generating apparatus and method which obviates the problems and disadvantages due to the conventional art.

An object of the present invention is to provide a playing sound generating apparatus and method which generates various playing sounds or tunes using a microcomputer and a timer while displaying a musical instrument keyboard on-screen, without requiring a separate sound source integrating device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
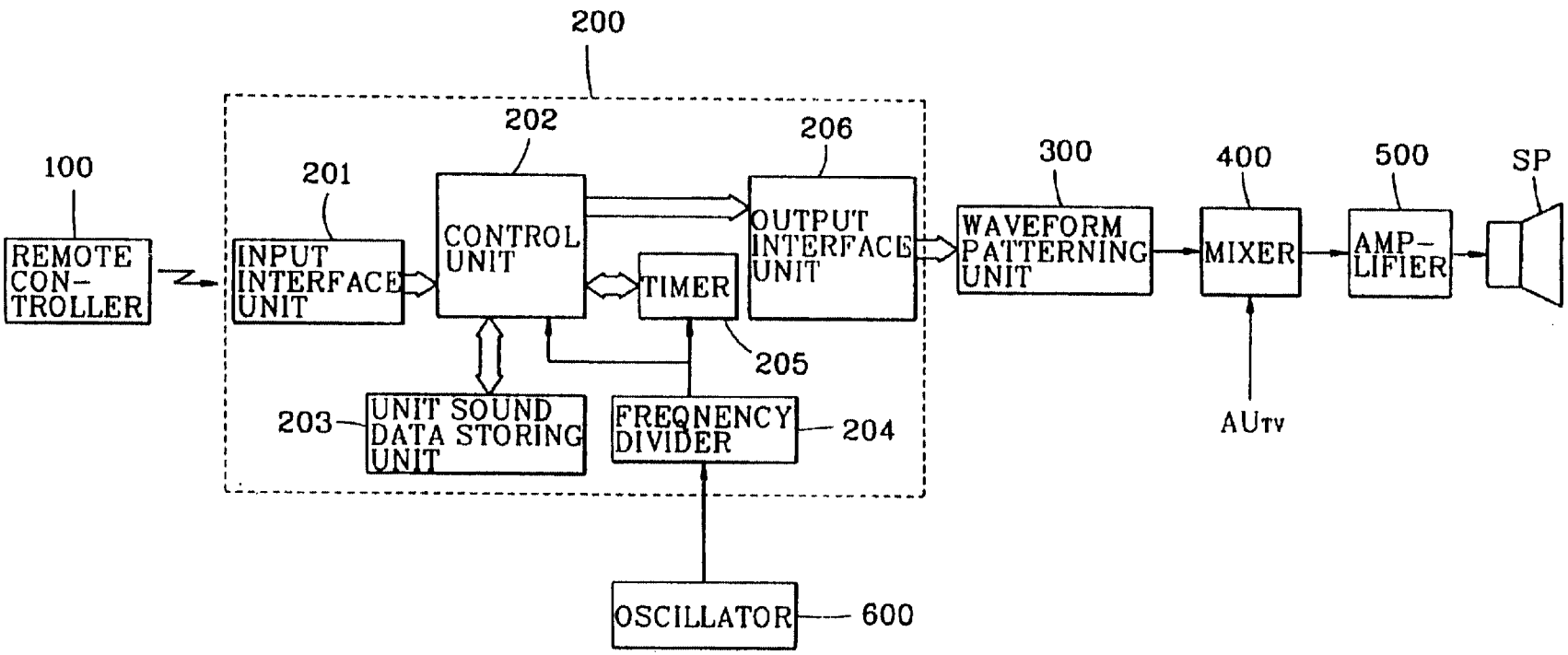
FIG. 1 is a schematic block diagram of an integral sound generating apparatus according to the present invention.

FIG. 1 illustrates a preferred embodiment of a playing sound generating apparatus according to the present invention. As shown therein, the playing sound generating apparatus of the present invention includes a remote controller 100 controlling a channel and volume and outputting a key signal to generate a specific sound or melody; a sound generating unit 200 setting a first timer by reading unit sound information which is stored in a unit sound data storing unit when the key signal is inputted from the remote controller 100 and generating a corresponding sound in accordance with an interrupt signal which is received from the timer; a waveform patterning unit 300 patterning a sound signal of a square wave type which is outputted from the sound generating unit 200 into a sound signal of a sine wave type; a mixer 400 mixing the sound signal outputted from the waveform patterning unit 300 with a TV sound signal $AU_{TV}$ outputted from a TV sound signal processing unit; and an amplifier 500 amplifying the sound signal outputted from the mixer 400 to a predetermined level and outputting the amplified signal to a speaker SP.

More specifically, the sound generating unit 200 is provided with an input interface unit 201 receiving and processing the key signal transmitted from the remote controller 100 and with an output interface unit 206 externally outputting the generated sound signal; a control unit 202 setting the first timer by reading the unit sound data stored in the unit sound data storing unit 203, which will be later described, when a specific unit sound or melody generation requiring signal is inputted through the input interface unit 201 and generating a sound signal of the square wave type in a cycle corresponding to the interrupt signal outputted from the timer; a unit sound data storing unit 203 storing sound pulse generating data in order to generate specific unit sounds such as a tone scale; a frequency divider 204 for dividing a referential oscillating signal outputted from an oscillator 600 into a predetermined frequency; and a timer 205 outputting an interrupt signal to the control unit 202 whenever an output signal of the frequency divider 204 which is counted reaches a point of time which is set by the control unit 202 as the corresponding unit sound data value.

Figures 2, 3:
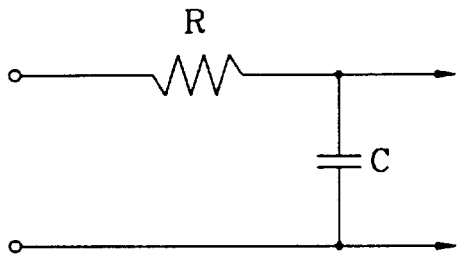
FIG. 2 is a circuit diagram of a waveform patterning unit in the apparatus of FIG. 1.
FIG. 3 is a table illustrating the characteristic frequencies of the notes of a musical scale.
Figure 4:
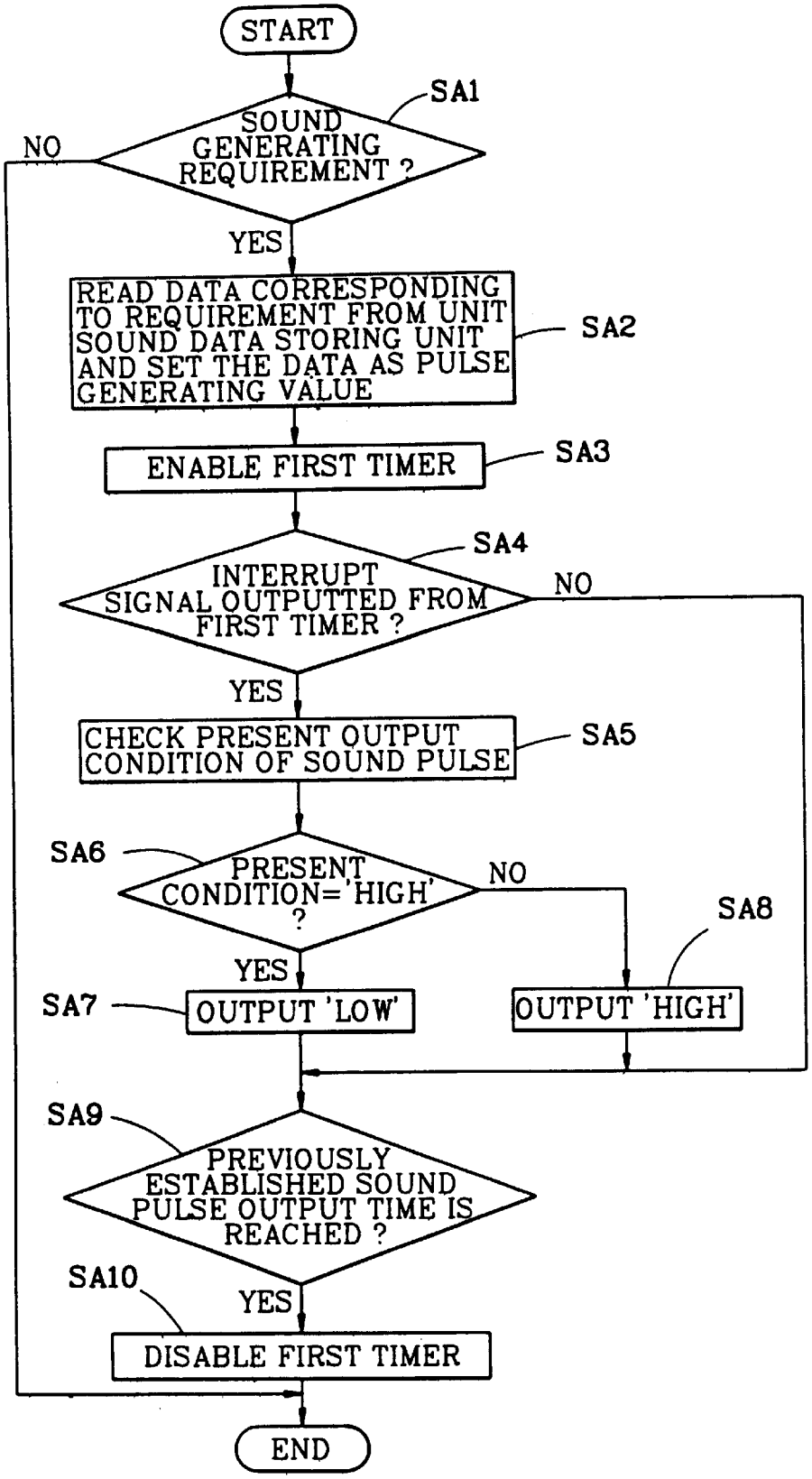
FIG. 4 is a flowchart illustrating the steps of a unit sound generating method according to the present invention.

Referring to FIGS. 2 through 4, the operation of the apparatus according to the present invention will now be described in detail.

For outputting a unit sound, for example a scale or a beep sound in a television set, the user switches a present mode to a sound generating mode by using a predetermined key provided on the remote controller 100 and presses a corresponding number key of the remote controller 100.

As an example, when the user operates the remote controller 100 so that a key signal is outputted therefrom to generate a simple tone 'do', the process of generating and outputting the simple tone will be explained.

First, when the key signal from the remote controller 100 is inputted through the input interface 201 to the control unit 202, the control unit 202 reads 'do' generating data from the unit sound data storing unit 203 in order to generate a 'do' sound, that is to generate a characteristic frequency of the 'do' sound, sets the data as a pulse generating value TM for generating the corresponding unit sound, enables the timer 205 and sets the timer 205 to the pulse generating value TM (steps SA1–SA3).

A characteristic frequency oscillating signal outputted from the oscillator 600 is divided by a predetermined ratio through the frequency divider 204 and the resultant signal is provided to the timer 205. Here, it is noted that the timer 205 counts the output signal of the frequency divider 204 and thus outputs the interrupt signal to the control unit 202 whenever the output signal of the frequency divider 204 reaches the predetermined value set by the control unit 202.

Accordingly, whenever the interrupt signal is outputted from the timer 205, the control unit 202 checks an output state of a present sound pulse signal. If the present sound pulse signal is low, the control unit 202 inverts the sound pulse signal to a high level, but if high, the control unit 202 inverts it to a low level (steps SA4–SA8).

Next, the control unit 202 checks whether or not a previously established sound pulse signal output time T is completed. If the sound pulse signal output time T is completed, the control unit 202 disables the timer 205 and finishes a sound pulse signal generating routine (steps SA9, SA10) and if not completed, the process is returned to the fourth step (SA4) and the above steps (SA4–SA8) are repeatedly performed.

Accordingly, a square wave pulse of the 'do' sound at 261.63 Hz is outputted from an output port of the control unit 202 and converted through the waveform patterning unit 300 into a patterned pulse as a sine wave. FIG. 2 illustrates an example of implementing the waveform patterning unit 300 as a low pass filter (LPF).

The patterned signal of the 'do' sound is supplied to the amplifier 500 through the mixer 400 to thereby amplify the signal to an appropriate level and externally outputted through a speaker SP, and accordingly the 'do' sound is also produced from the speaker SP.

Now, how a sound pulse signal generating data value stored in the unit sound data storing unit 203 is produced and also how the unit sound is produced in accordance with the data value will be described in more detail.

For example, when generating the unit sound which is the 'do' sound, the square wave pulse at 261.63 Hz is generated from the control unit 202. Here, the case where an oscillating frequency of the oscillator 600 is 8 MHz and the frequency divider 204 is a 1/16 frequency divider will be explained.

In such a case, a 500 KHz frequency signal (8 MHz×1/16=500 KHz) is outputted from the frequency divider 204 and at this time the timer 205 should supply an interrupt signal twice a cycle of a square wave pulse, that is at each of the positive (rising) and negative (falling) edges of the square wave pulse which the control unit 202 is to generate. Accordingly, a pulse generating data value TM of the 'do' sound stored in the unit sound data storing unit 203 is as follows:

$$TM = \frac{\text{frequency of the frequency divider}}{\text{unit sound frequency} \times 2} = \frac{500\,\text{KHz}}{261.63\,\text{Hz} \times 2} \simeq 955 \quad (1)$$

(1)

In other words, when generating the 'do' sound, the pulse generating value of the 'do' sound, "955", is stored in the unit sound data storing unit 203 and the control unit 202 reads and sets the value in the timer 205. Then, the timer 205 counts the output pulses of the frequency divider 204 and outputs the interrupt signal to the control unit 202 whenever a pulse signal of 955 cycles is inputted thereto, and the control unit 202 inverts and outputs a present pulse output state, thereby outputting the square wave pulse of the 'do' sound.

In FIG. 1, it is noted that the mixer 400 is used in order to simultaneously output the TV sound signal $AU_{TV}$ which is processed in an audio signal processing unit (not shown) of the TV set and the sound signal which is produced according to the above process. Here, the TV sound signal $AU_{TV}$ can be selectively cut off when necessary. For reference, the data stored in the unit sound data storing unit 203 can be 'do', 're', 'mi', 'fa', 'sol', 'la' and 'si', or the twelve-tone system data of oriental music.

Figure 5:
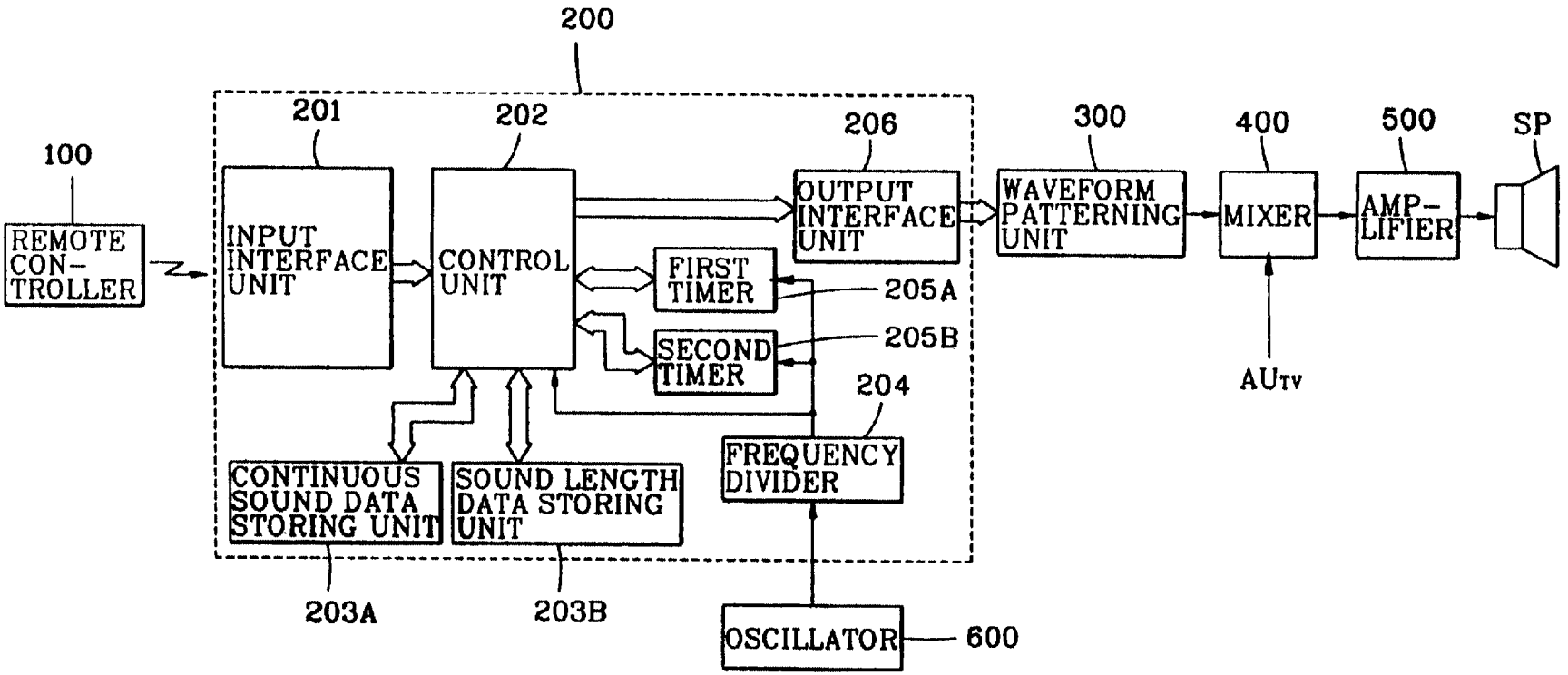
FIG. 5 is a schematic block diagram of a continuous sound generating apparatus according to the present invention.

FIG. 5 is a schematic block diagram illustrating another implementation of the sound generating apparatus of the present invention. In this implementation of the sound generating unit, there are provided a control unit 202 for setting a first timer 205A with unit sound pulse signal generating data stored in a continuous sound data storing unit 203A when there is a continuous sound generating requirement, then generating a sound pulse signal using an interrupt signal outputted from the first timer 205A and determining a duration of the sound pulse signal using an interrupt signal outputted from a second timer 205B in accordance with a sound duration value stored in a sound duration data storing unit 203B; the continuous sound data storing unit 203A for storing a plurality of pulse generating data which are continuously provided; the sound duration data storing unit 203B for storing data for determining a length of each sound; the first timer 205A being set by the control unit 202 with pulse generating data of a corresponding sound and then counting an output signal of the frequency divider 204 for thereby outputting the interrupt signal to the control unit 202 whenever the sound pulses signal reaches a corresponding point of time; and the second timer 205B being set with the sound duration value stored in the sound duration data storing unit 203B and then counting an output signal of the frequency divider 204 for thereby generating and outputting an interrupt signal to the control unit 202 as a predetermined number. The operation of this implementation will be explained with reference to FIGS. 6A–6C.

Figure 6A:
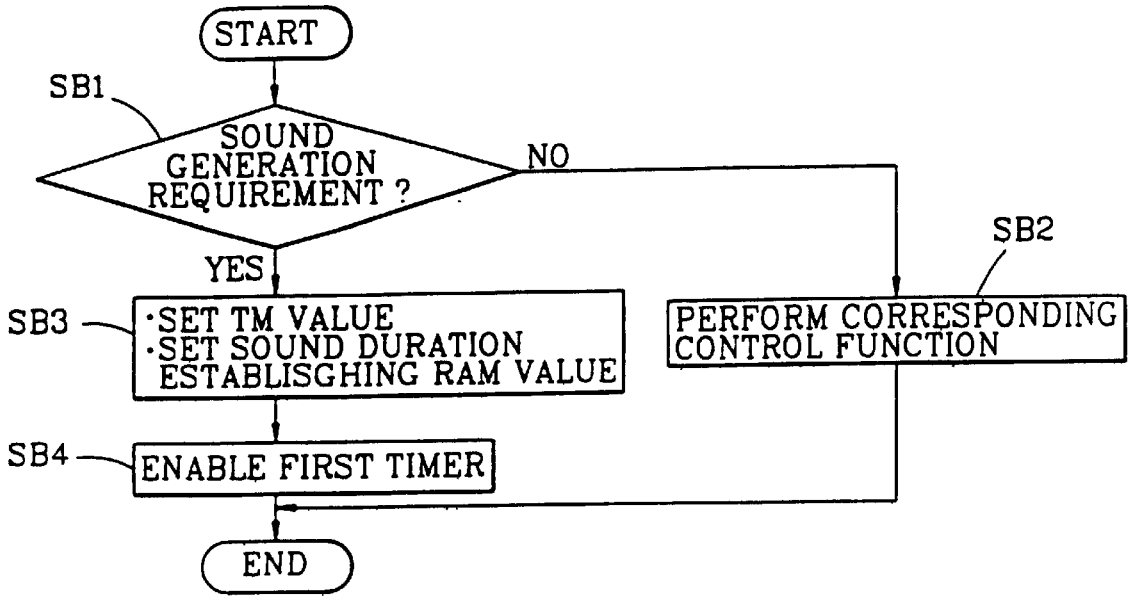
FIGS. 6A through 6C are flowcharts illustrating respective routines and steps of a continuous sound generating method according to the present invention.

The continuous sound pulse signal generating data to be continuously generated are stored in the continuous sound data storing unit 203A and data for determining the duration of each unit sound which is stored in the continuous sound data storing unit 203A are stored in the sound duration data storing unit 203B. As shown in FIG. 6A, if no continuous sound generating requirement is made by the user, the control unit 202 performs other control functions and if there is such a requirement made, the control unit 202 reads the corresponding data from the continuous sound data storing unit 203A to thereby establish the data as a pulse generating value TM in an internal RAM, reads the sound duration value of the corresponding unit sound stored in the sound duration data storing unit 203B, stores the value in an internal sound duration establishing RAM and sets a pulse generating value TM thereof in the first timer 205A (steps SB1–SB4). Here, it is noted that the first timer 205A has the same function as the timer 205 in FIG. 1.

Figure 6B:
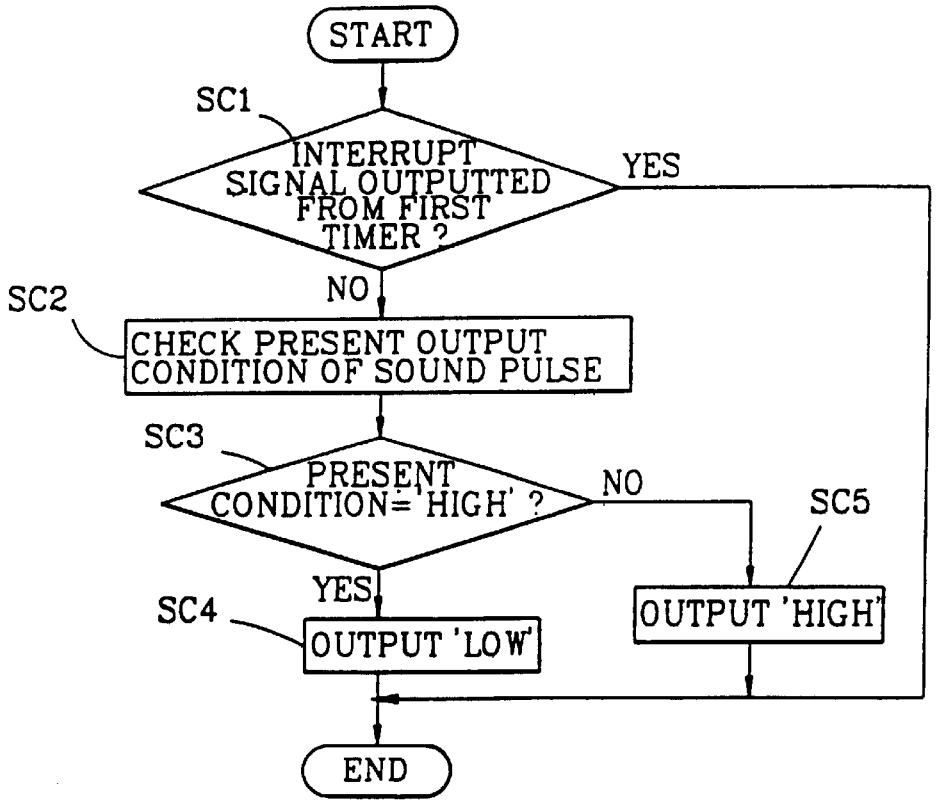
Figure 6C:
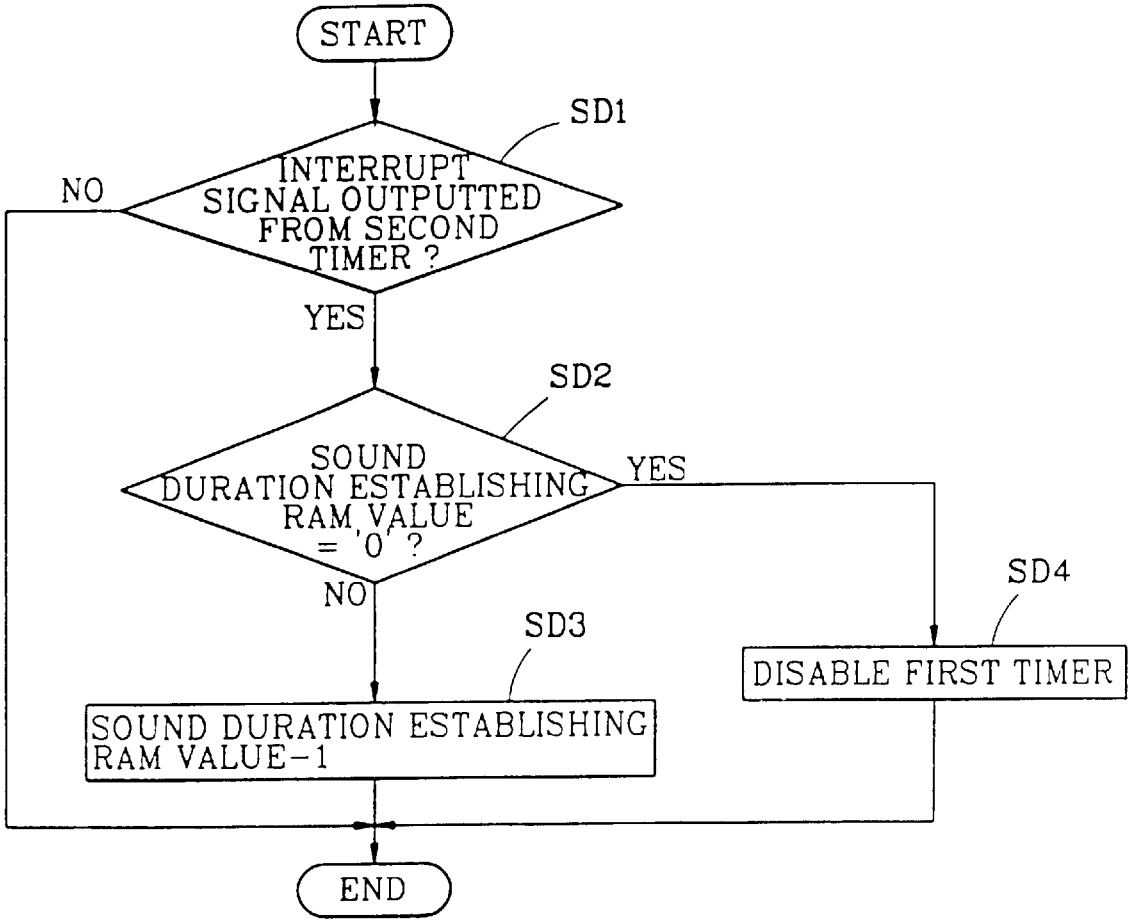

Next, as shown in FIG. 6B, the control unit 202 checks the present sound pulse signal output state whenever the interrupt signal is outputted from the first timer 205A and inverts the present output state of the sound pulse signal from 'low' to 'high' or from 'high' to 'low', thus outputting a sound generating square wave pulse signal of the corresponding unit sound from the output port as in the description of FIG. 1 (steps SC1–SC5). However, to determine the sound duration of the square wave signal of the unit sound, the control unit 202 decreases the value of the sound duration establishing RAM by 1 and disables the first timer 205A when the value thereof becomes zero (steps SD1–SD4).

Thus, the sound duration of a single unit sound is outputted as a previously established length and such an operation is repeatedly performed until a last unit sound of the continuous sound is outputted, thus eventually outputting the continuous sound as a desired length.

Figure 7:
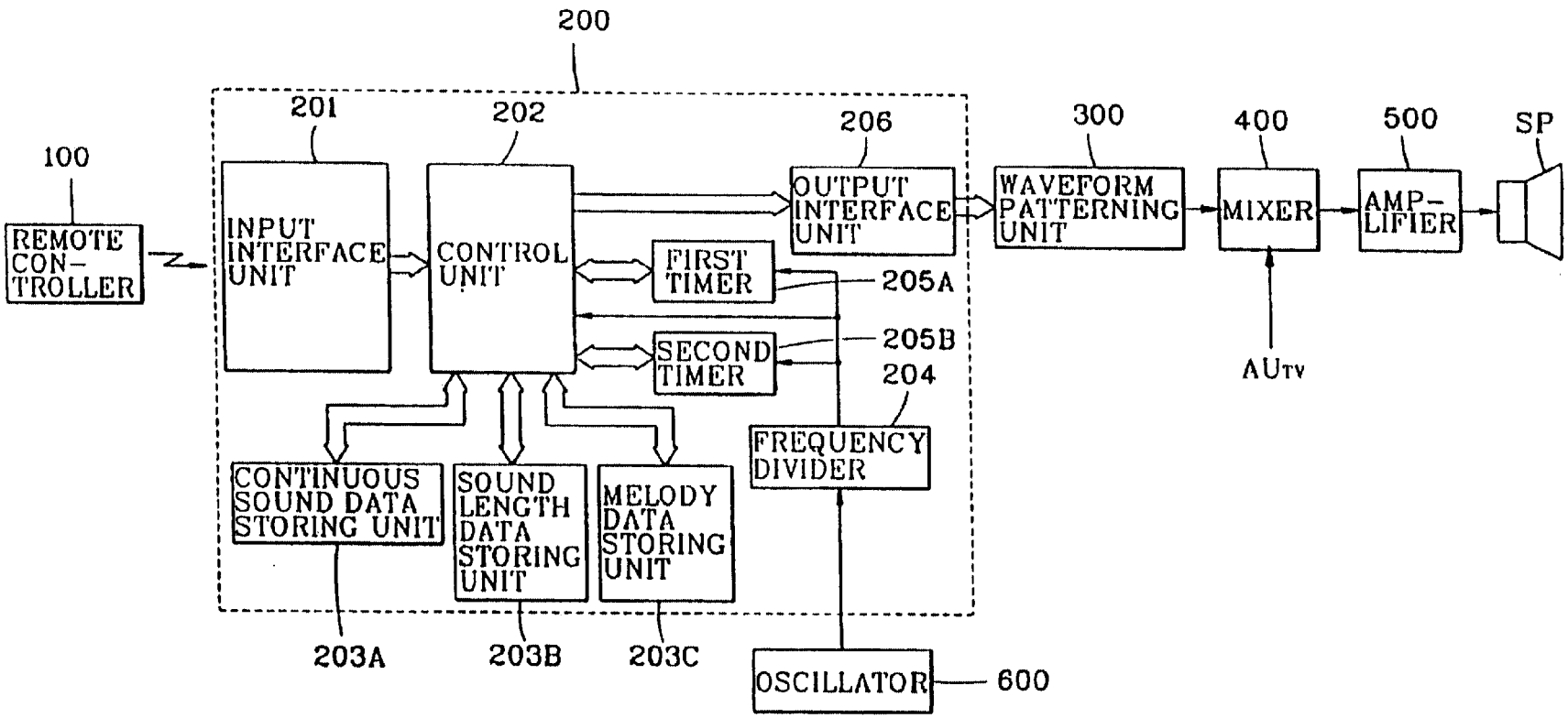
FIG. 7 is a schematic block diagram of a melody generating apparatus according to the present invention.
Figure 8:
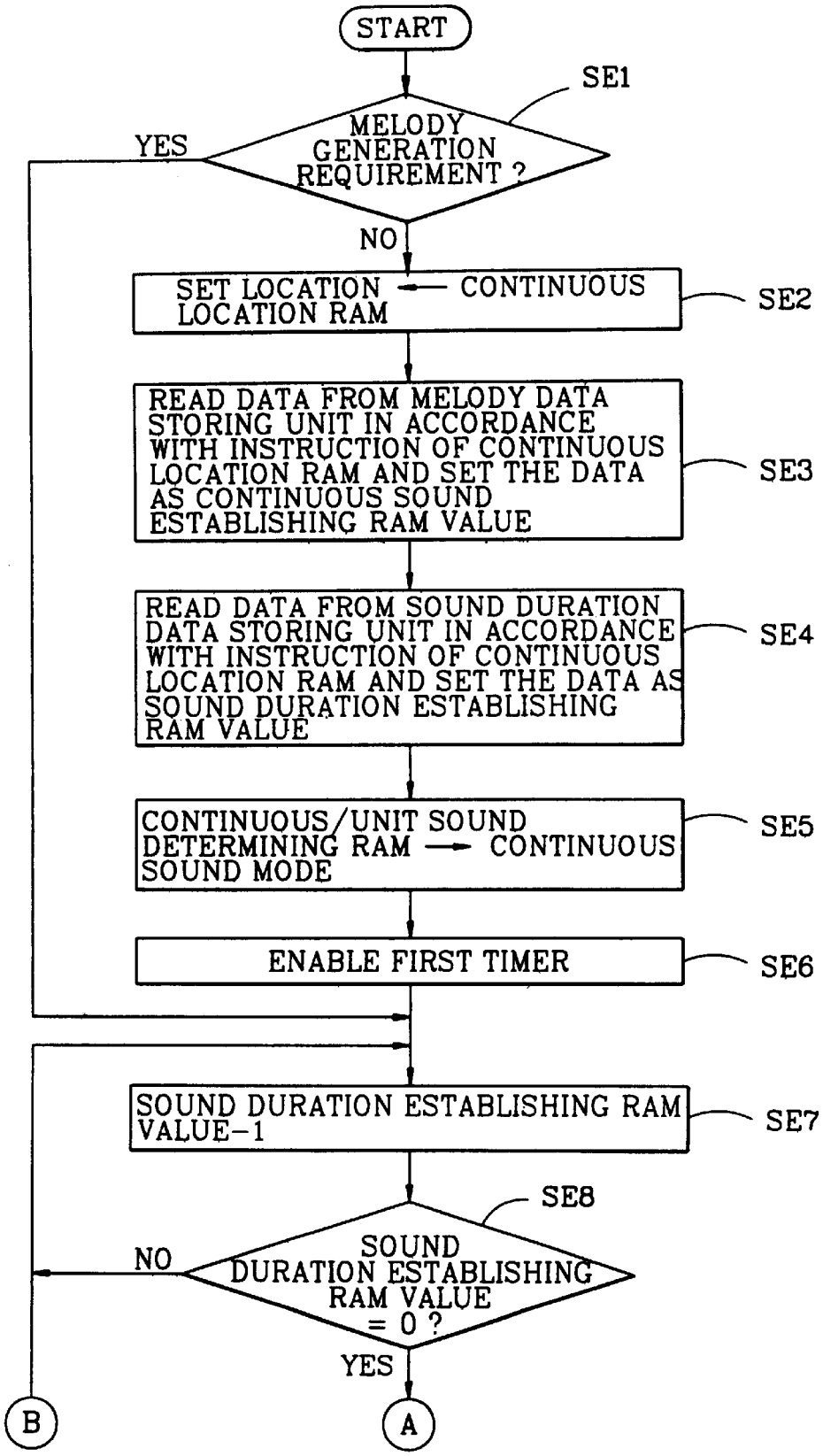
FIG. 8 is a flowchart illustrating steps of a melody generating method according to the present invention.
Figure 8:
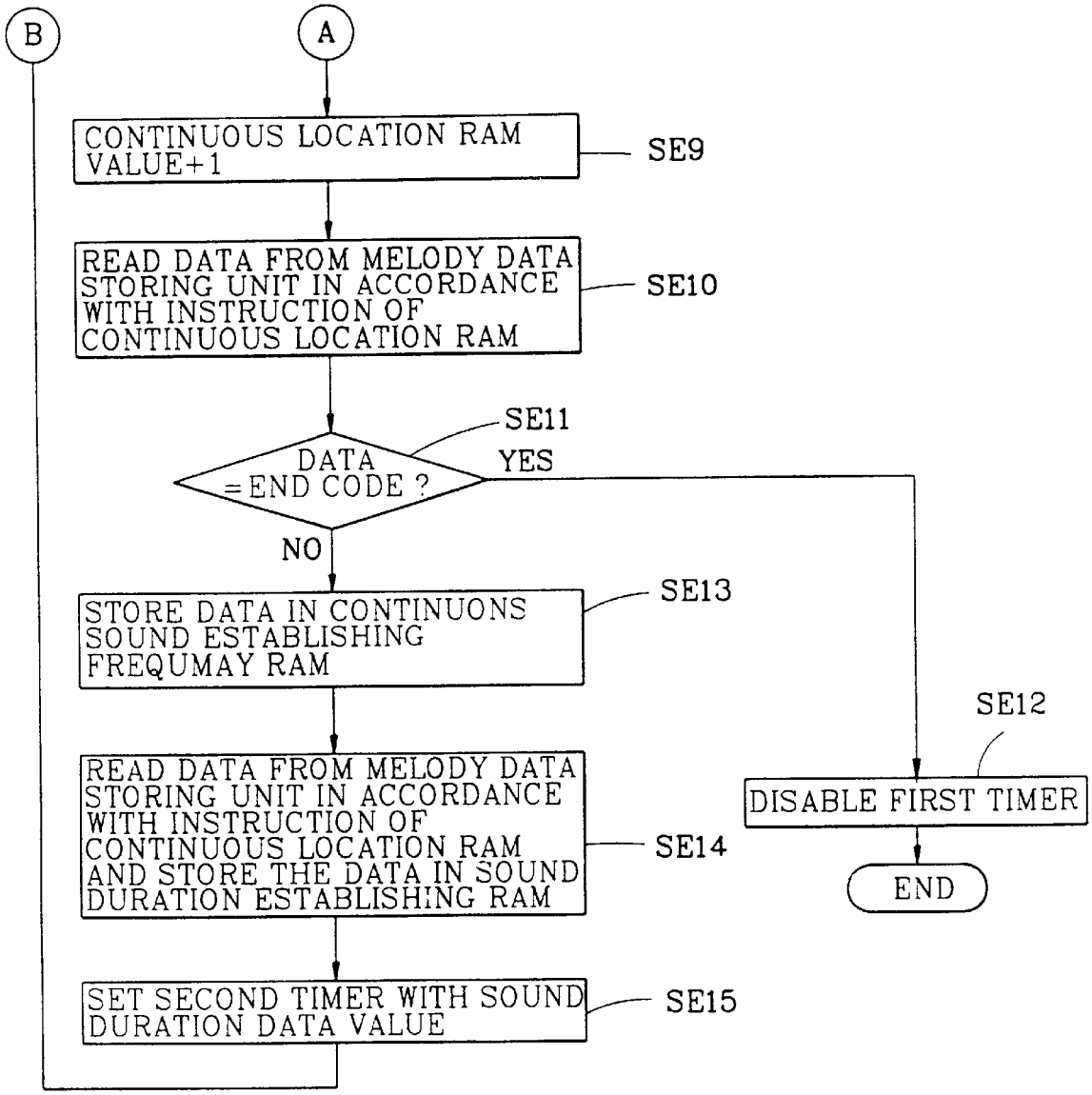

FIG. 7 is a schematic block diagram illustrating another implementation of the sound generating apparatus of the present invention. The sound generating apparatus according to this implementation includes a control unit 202 for reading data from a melody data storing unit 203C and data from a sound duration data storing unit 203B, which will be later described, and outputting continuous pulse signal with respect to a melody by controlling a first timer 205A and a second timer 205B in accordance with a value of the data; a unit sound data storing unit 203 for storing pulse generating data of a plurality of unit sounds; the sound duration data storing unit 203B for storing data for determining a duration of each sound to be produced; the melody data storing unit 203C for sequentially storing addresses of the unit sound data storing unit 203 and the sound duration data storing unit 203B in order to read unit sound data and sound duration data of the corresponding melody; the first timer 205A being set with pulse generating data of the corresponding melody sound and then counting an output signal of a frequency divider 204 for thereby outputting the interrupt signal to the control unit 202 whenever a corresponding point of time is reached; and the second timer 205B being set with the sound duration value stored in the sound duration data storing unit 203B and then counting an output signal of the frequency divider 204 for thereby generating and outputting an interrupt signal to the control unit 202 as a predetermined number.

In the thusly described apparatus, when a melody generating requirement is made by the user, the control unit 202 determines a location for generating a melody on an internal continuous location RAM, reads one of the melody data from the melody data storing unit 203C and stores the thusly read data in a continuous sound determining frequency RAM (steps SE1–SE3).

Next, the control unit 202 reads sound duration data from the sound duration data storing unit 203B, stores the data in a sound duration determining RAM in accordance with the instruction of the continuous location RAM and enables the first timer 205A after establishing a continuous/unit sound determining RAM as a continuous sound mode (steps SE4–SE6). Also, the first timer 205A performs the same operation as the timer 205 of FIG. 1.

Further, as shown in FIG. 7, the square wave pulse of the corresponding melody is generated in accordance with the interrupt signal outputted from the first timer 205A and simultaneously the control unit 202 decreases the value in the sound duration establishing RAM by 1 whenever receiving the interrupt signal from the second timer 205B, thereby establishing a time until the value becomes zero as the sound duration (steps SE7, SE8). In this way, when the value in the sound duration establishing RAM reaches zero, the control unit 202 increments the addresses in the continuous location RAM by one and reads following melody data from the melody data storing unit 203C in accordance with the instruction in the continuous location RAM to thereby check whether the data is an end code. If the data is the end code, the first timer 205A is disabled and the melody generating operation is completed (steps SE9–SE12). If the data is not the end code, after storing the melody data in the continuous sound establishing frequency RAM, the control unit 202 reads the sound duration data from the sound duration data storing unit 203B, stores the data in the sound duration establishing RAM in accordance with the instruction in the continuous location RAM, sets the value of the data in the second timer 205B and returns to step 7 (SE7) to thereby repeatedly perform the above steps (SE13–SE15).

While repeating the above steps, if the end code stored at the end of the melody data is detected, the first timer 205A is accordingly disabled and the melody generating operation is completed.

Figure 9:
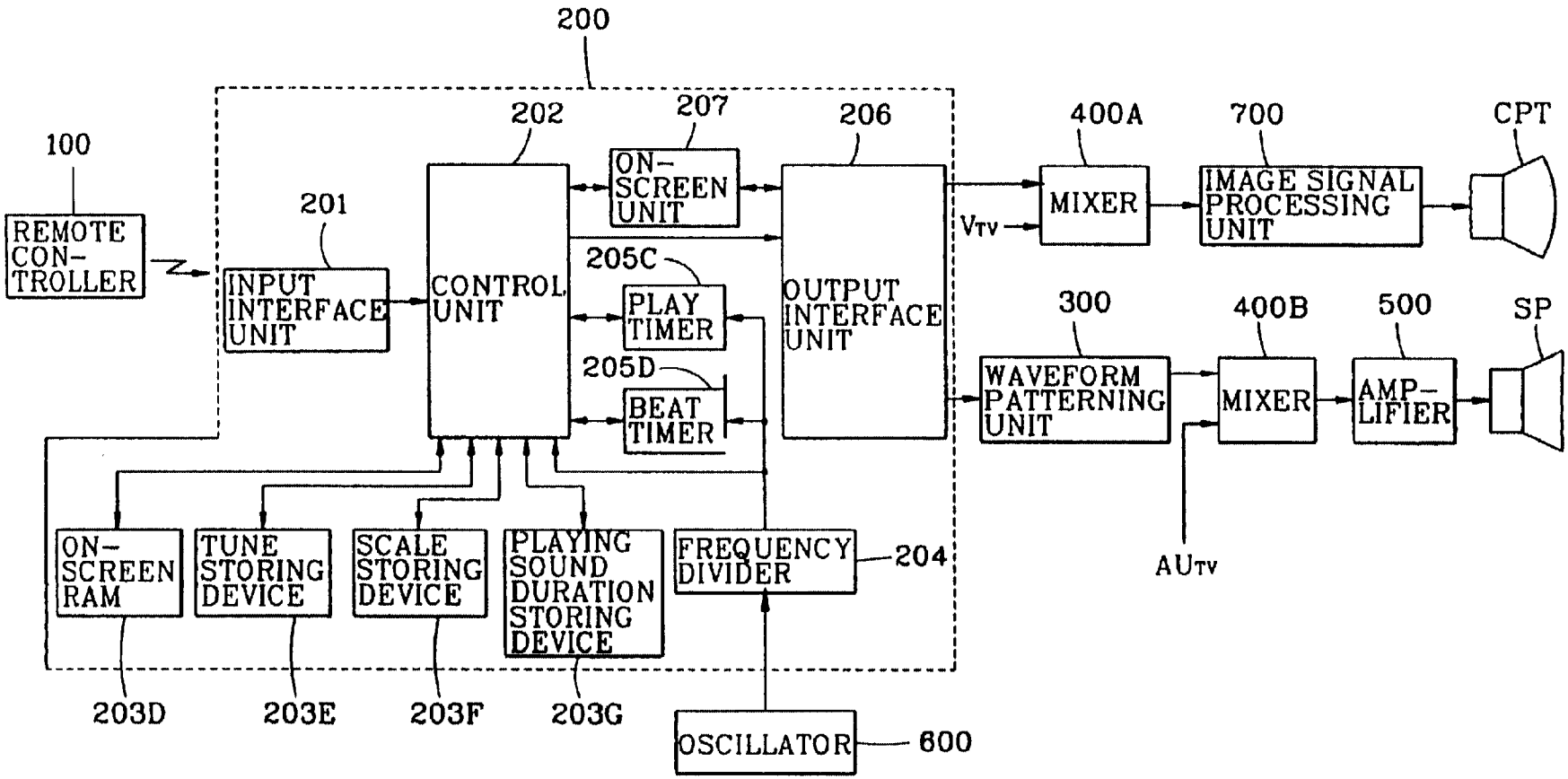
FIG. 9 is a schematic block diagram of a user playing apparatus according to the present invention.

FIG. 9 is a schematic block diagram of an embodiment of a user playing apparatus of a television set according to the present invention. As shown therein, the user playing apparatus is provided with a remote controller 100 establishing a channel and volume and outputting a key signal for inputting a scale of a tune which is to be played; a control unit 202 controlling an on-screen display (OSD) unit 207 in accordance with keyboard data and scale data which are stored in an on-screen RAM display 203D, establishing conditions for sound generation by reading data stored in a scale storing device 203F and a playing sound duration storing device 203G and then generating a playing sound pulse signal of a square wave type using interrupt signals outputted from a play timer 205C and a beat timer 205D in order to display a pressed state of the keyboard in a playing mode and generate a playing sound of the corresponding tone in accordance with the key signal input of the user; a mixer 400A mixing an on-screen display signal for keyboard display which is outputted from the on-screen display unit 207 and a TV image signal $V_{TV}$; an image signal processing unit 700 processing an image signal which is outputted from the mixer 400A to be suitable for being displayed on a screen and outputting the processed signal to a color picture tube (CPT); a waveform patterning unit 300 performing a low pass filtering of a playing sound signal of the square wave type outputted from the control unit 202 to thereby pattern the playing sound signal into a signal of a sine wave type; a mixer 400B mixing the playing sound signal outputted from the waveform patterning unit 300 and a TV sound signal $AU_{TV}$ which has been processed in an audio signal processing unit of the TV set; an amplifier 500 amplifying a sound signal outputted from the mixer 400B to a certain level and outputting the amplified signal to a speaker SP; and an oscillator 800 supplying a pulse signal of a predetermined frequency which is required in a sound generating unit 200.

Also, a playing method of the TV set implementing a user playing apparatus according to the present invention includes a step of displaying a representation of a musical instrument keyboard on a screen using data stored in the on-screen RAM in accordance with a playing key input of a user and displaying a key corresponding to a selected note differently from other displayed keys; generating a sound pulse signal of a frequency which corresponds to a value of data stored in the playing sound duration storing device; and establishing a length of a playing sound to correspond to a value of data stored in the playing sound duration storing device.

Figure 14A:
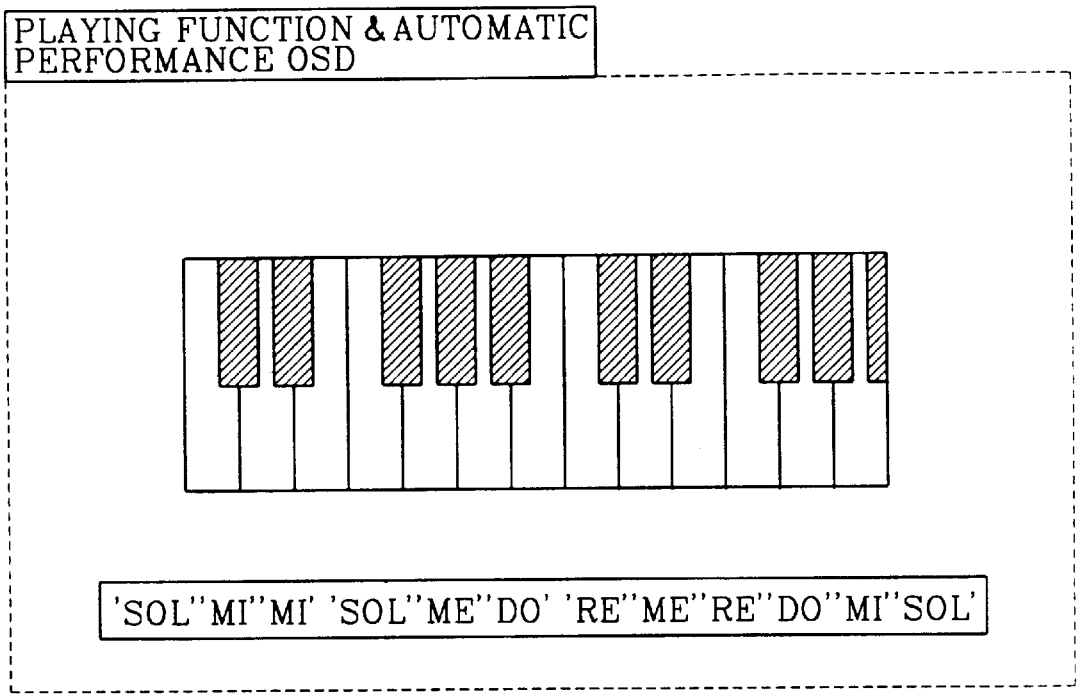
FIG. 14A is an example of an on-screen keyboard display according to the present invention.
Figure 14B:
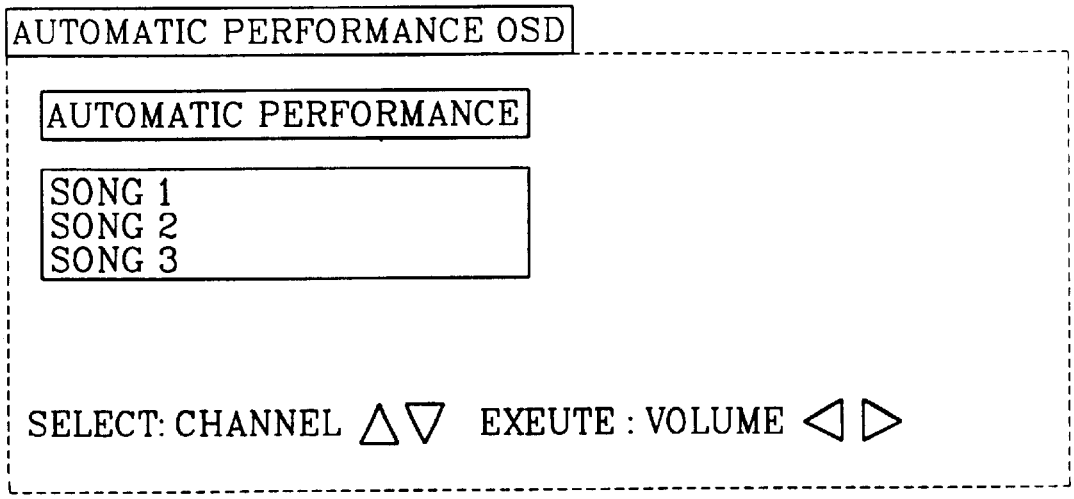
FIG. 14B is a diagram of a menu screen for selecting music in the automatic performance.

Now, the playing sound generating process in response the user's playing will be explained with reference to FIGS. 9, 11 and 14A.

First, when the user sets up the playing mode using the remote controller 100, the control unit 202 reads keyboard on-screen display data stored in the on-screen display RAM 203D and thus controls the on-screen display unit 207. Thus, a keyboard on-screen display signal is outputted from the on-screen display unit 207, the keyboard on-screen display signal being supplied through the mixer 400A and the image signal processing unit 40 to the CPT. Accordingly, the musical keyboard representation is displayed on the screen of the CPT as shown in FIG. 14A and at this time the user inputs the scale of a tune which the user wants to play, using keys, for example the number keys, which are provided on the remote controller 100.

Here, in order to generate the inputted scale, the control unit 202 reads the corresponding data from the scale storing device 203F and the playing sound duration storing device 203G and thereby establishes the condition for the sound generation. Next, whenever an interrupt signal is outputted from the play timer 205C, the control unit 202 checks a present condition of a sound pulse signal output state and then inverts the present condition thereof to the opposite state, for example from 'low' to 'high' or from 'high' to 'low', thereby generating the sound signal corresponding to the selected scale as a the square wave type.

At the same time, since the duration of the scale is established by the interrupt signal which is outputted from the beat timer 205D, a sound signal of the corresponding scale is outputted for a corresponding duration from an output port of the control unit 202. For example, when generating a 'do' sound, the control unit 202 generates a square wave pulse having a frequency of 261.63 Hz. Here, when an oscillating frequency of the oscillator 800 is 8 MHz and the frequency divider 204 is a 1/16 frequency divider, a 500 KHz frequency signal of (8 MHz×1/16=500 KHz) is outputted from the frequency divider 204 and at this time the play timer 205C should supply an interrupt signal twice a cycle of the square wave pulse signal, that is at each of rising and falling edges of the square wave pulse signal which the control unit 202 is to generate. Accordingly, a pulse generating data value TM of the 'do' sound which is stored in the scale storing device 203F is as follows:

$$TM = \frac{\text{frequency of the frequency divider}}{\text{unit sound frequency} \times 2} = \frac{500\ \text{KHz}}{261.63\ \text{Hz} \times 2} \simeq 955 \qquad (2)$$

In other words, when generating the 'do' sound, the pulse generating value TM of the 'do' sound, "955", is stored in the scale storing device 203F and the control unit 202 reads and sets the value in the timer 205C. Then, the timer 205C counts output pulses of the frequency divider 204 and outputs the interrupt signal to the control unit 202 whenever a pulse signal of 955 cycles is inputted, and the control unit 202 inverts and outputs a present pulse output state, thereby outputting the square wave pulse signal of the 'do' sound. Through the above process, whenever the user inputs a desired scale, the sound corresponding to the scale is outputted through the speaker SP and such an operation is successively performed, thereby generating a playing sound of the corresponding tune.

At this time, the scale, for example, is displayed on the screen of the CPT, as shown in FIG. 6A, and the control unit 202 displays the key corresponding to the presently outputted sound on the basis of data in the on-screen display RAM 203D in a different color from the other keys or displays the key in a pressed state. Further, at a bottom part of the on-screen keyboard representation, there is displayed the scale which has been played so far, thus providing a teaching effect. Also, the playing scale which is inputted by the user can be stored in the storing device through the above process and reproduced if necessary.

Figure 11:
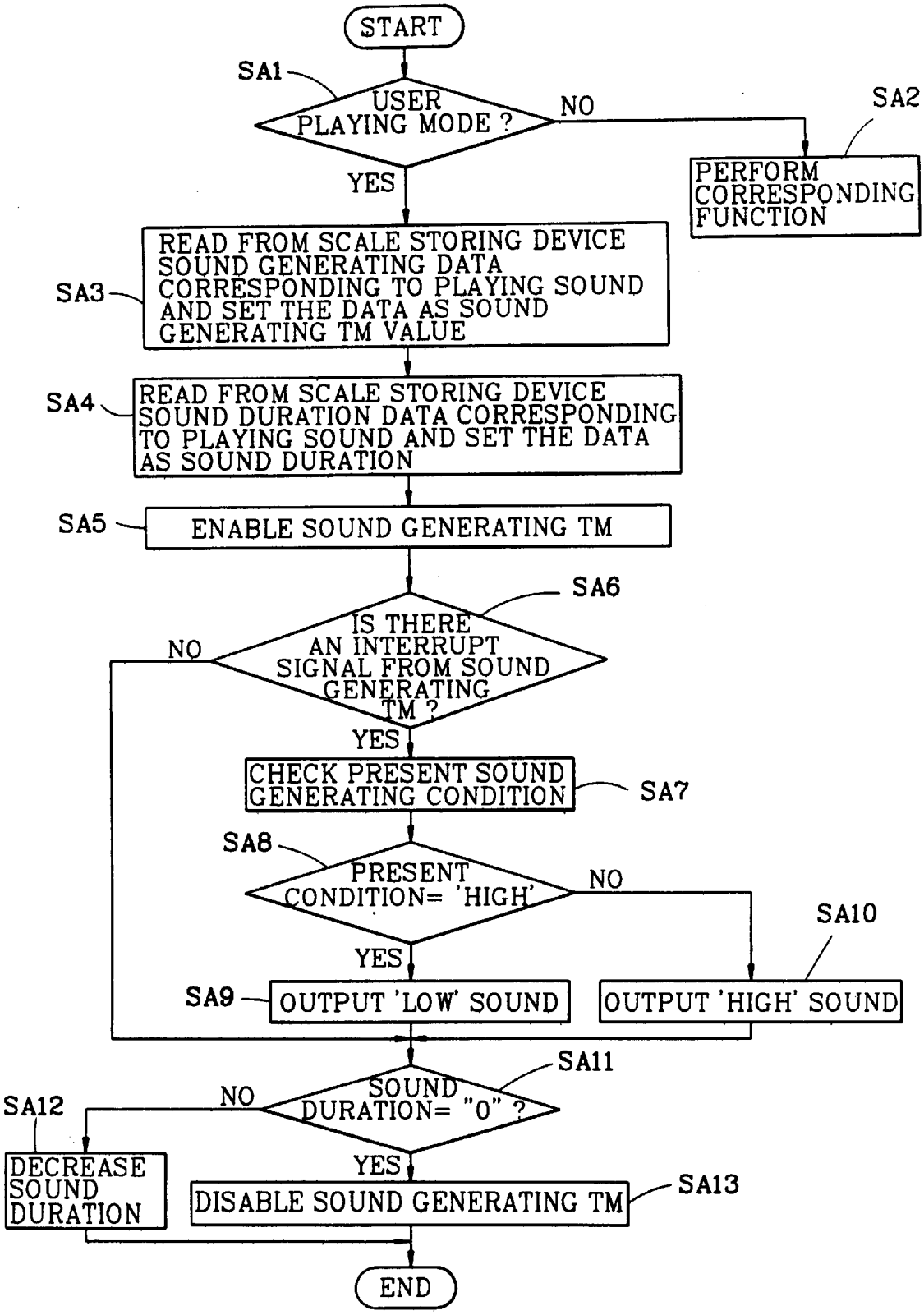
FIG. 11 is a flowchart illustrating steps of a user playing method according to the present invention.

FIG. 11 is a flowchart illustrating steps of a user playing method according to the present invention. As shown therein, in a step (SA1) it is determined whether or not an input is a user playing mode. If it is not the user playing mode, the apparatus according to the present invention performs a corresponding function (SA2), and if it is the user playing mode, sound generation data with respect to the corresponding play sound are read from the scale storing device 203F so that a pulse generating data value (SA3) is set, sound duration data with respect to the corresponding play sound are read also from the scale storing device 203F so that the read sound duration data are set as a sound duration (SA4), then the sound generation TM is enabled (SA5) and it is determined whether or not there is an interrupt signal from the sound generation TM (SA6). Here, if there is the interrupt signal from the sound generation TM, the present sound generation state is checked (SA7) and then it is checked whether or not the present sound generation state is a high potential state (SA8). If the present state is the high potential state, a 'low' sound is outputted (SA9), whereas if it is a low potential state, a 'high' sound is outputted (SA10). In the above step (SA6), when it is determined that there is no interrupt signal, it is checked whether or not the sound duration is zero (SA11). If the sound duration is zero, the sound generation TM is disabled (SA13) and if not, the sound duration is decreased (SA12) and the process is completed.

Figure 10:
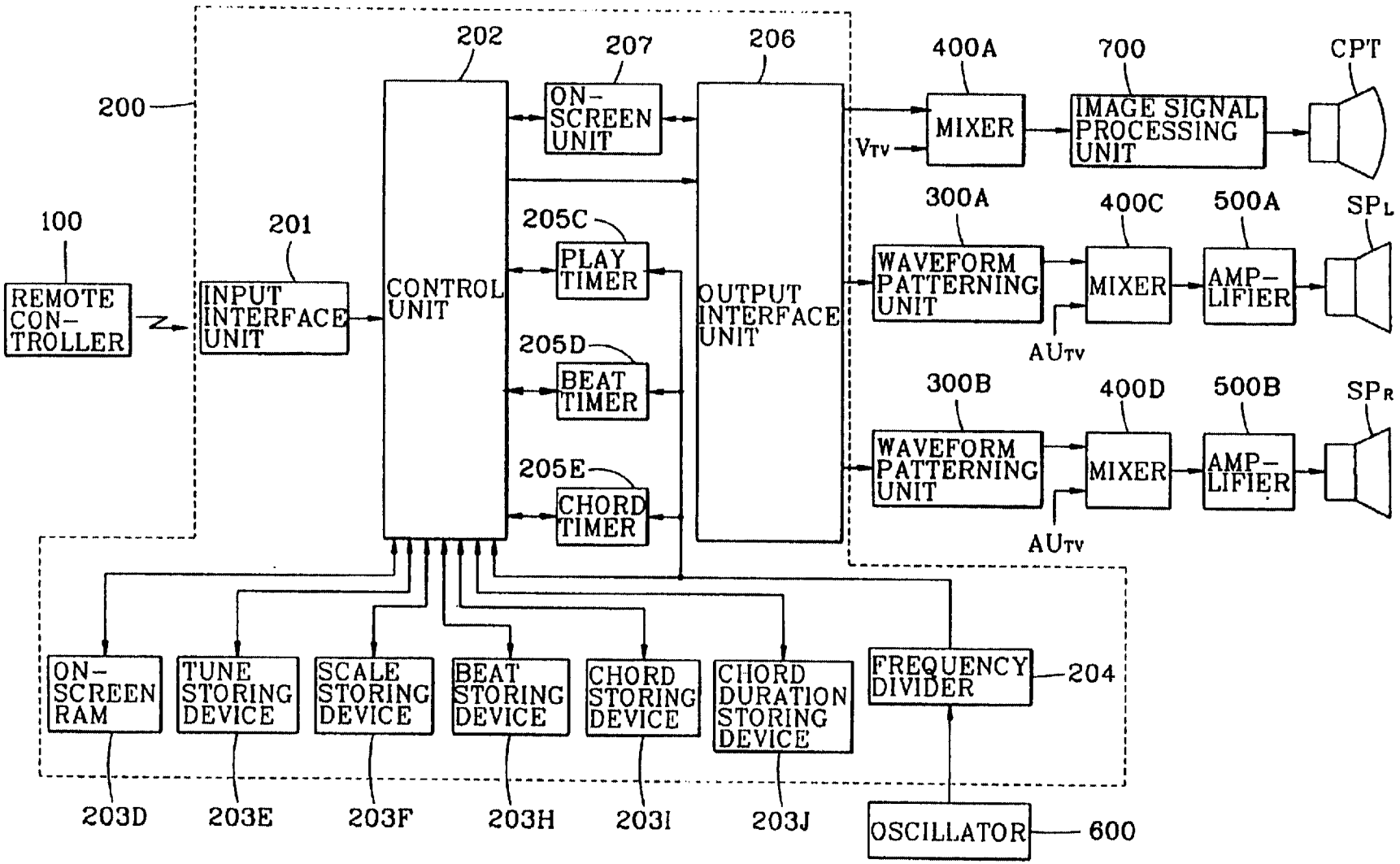
FIG. 10 is a schematic block diagram of an automatic playing apparatus according to the present invention.

FIG. 10 is a schematic block diagram illustrating an embodiment of an automatic playing apparatus for a TV set according to the present invention. As shown therein, in order to simultaneously output a playing sound and a chord in an automatic playing mode, in the sound generating unit 200 there are additionally provided: a chord storing device 203I storing chord data, a chord duration storing device 203J storing chord duration data, and a chord timer 205E establishing a duration of a chord, and respective left and right waveform patterning units 300A, 300B, mixers 400C, 400D, amplifiers 500A, 500B and speakers $SP_L$, $SP_R$ are connected, with output terminals of the output interface unit 206.

With reference to FIGS. 10, 12, 14A and 14B, the operation of the automatic playing apparatus of the TV set of the present invention will now be described.

When the user selects the automatic playing mode using the remote controller 100, the control unit 202 controls the on-screen display unit 207 for thereby displaying a program selection menu screen, as shown in FIG. 6B and accordingly the user selects a desired tune using keys, for example channel and volume keys of the remote controller 100.

Next, in order to automatically play the selected tune, the control unit 202 reads data corresponding to the selected tune from a tune storing device 203E and generates a playing sound as described above as well as a chord. Here, singing of the user which is inputted through a microphone is outputted with the playing sound and chord.

That is, the control unit 202 first initializes the on-screen display RAM 203D, reads on-screen display information for displaying a keyboard representation in the automatic playing mode and establishes an address to sequentially read scale data of the corresponding tune from the tune storing device 203E. Next, the control unit 202 generates the playing sound through the process already described above and establishes a condition for the chord generation by reading chord data from the chord storing device 203I. Further, after establishing a condition of a chord duration by reading corresponding data from the chord duration storing device 203J, the control unit 202 generates the chord which has the corresponding duration as a square wave type signal using the interrupt signal of the chord timer 205E and, at the same time, establishes a duration of the scale by using the interrupt signal outputted from the beat timer 203E, thereby eventually outputting from the output port of the control unit 202 a sound pulse of the corresponding scale.

In addition, the sound pulse signal outputted from the control unit 202 is patterned through the waveform patterning unit 300A, as described above, and supplied to the speaker $SP_L$ through the mixer 400C and the amplifier 500A, and also left sound signals $AU_L$ of sounds of the user's singing are mixed and outputted through the mixer 400C. Similarly, a chord pulse signal outputted from the control unit 202 is supplied to the speaker $SP_R$ through the mixer 400*d* and the amplifier 500B after being patterned through the waveform patterning unit 300B as described above, and right sound signals $AU_R$ of the sounds of the user's singing are mixed and outputted through the mixer 400D.

Accordingly, in the chord output mode, the playing sound and the left channel sounds of the user's singing are outputted from the speaker $SP_L$ and the chord and the right channel sounds thereof are outputted from the speaker $SP_R$. In this way, the playing sound and the chord with respect to the single unit scale and the singing are generated and the keyboard representation is displayed on-screen. Then, such a process is repeatedly performed by incrementing the address for reading scale data again and then the whole process is completed after the last data of the tune is processed.

Figure 12:
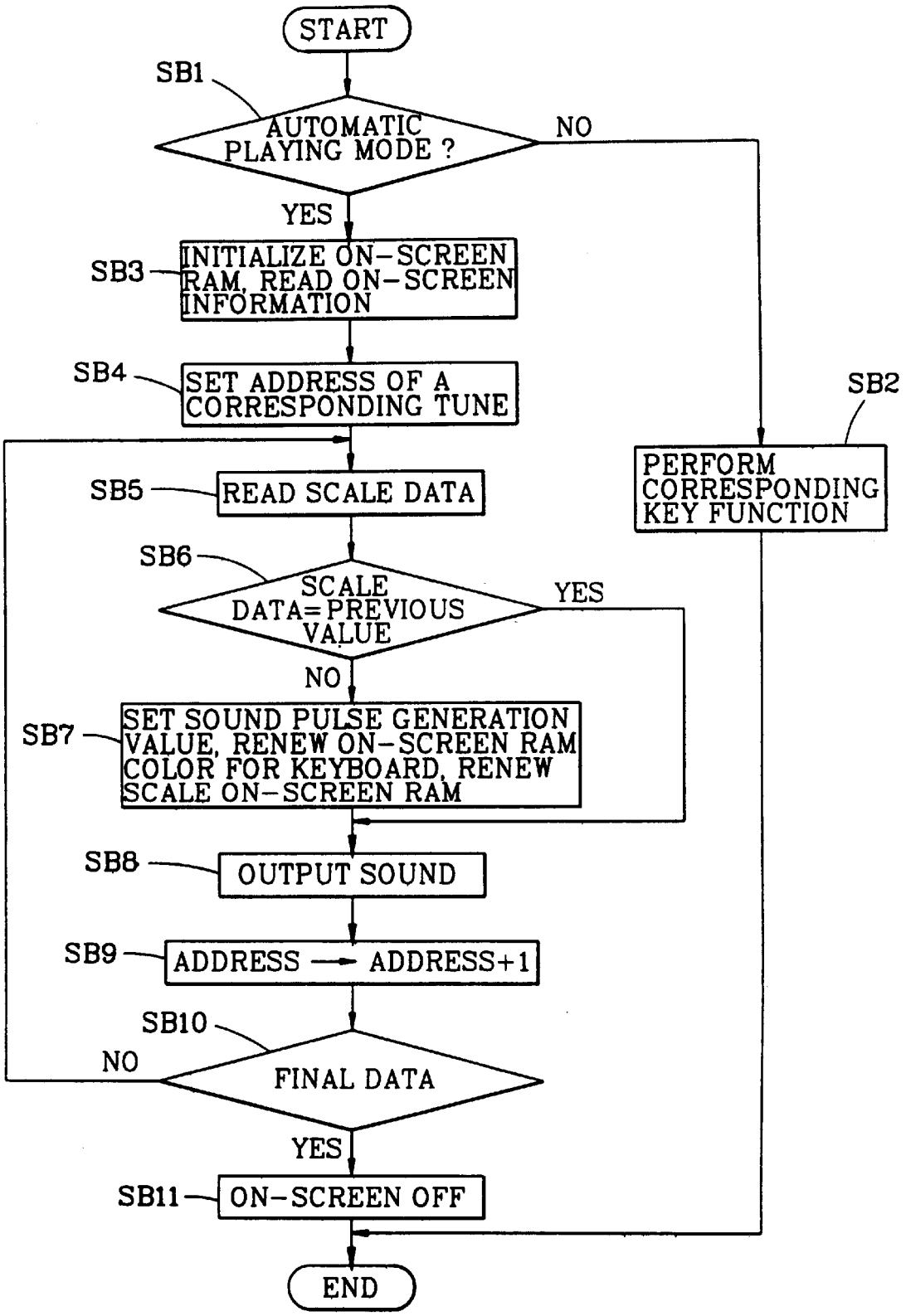
FIG. 12 is a flowchart illustrating steps of an automatic playing method according to the present invention.
Figure 13:
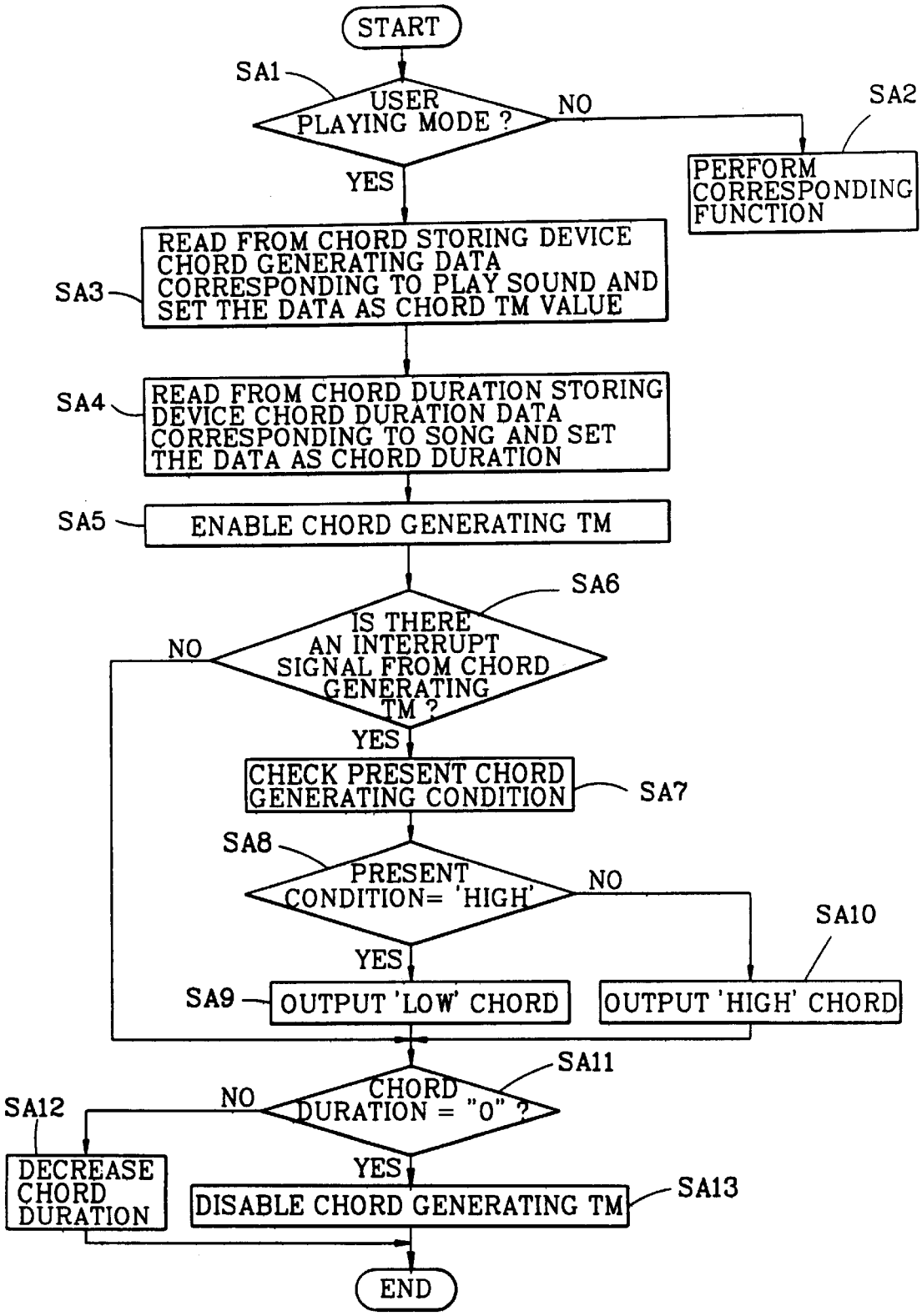
FIG. 13 is a flowchart illustrating steps for chord generation in performing an automatic performance according to the present invention.

Referring to FIGS. 12 and 13, the above-described operation will now be explained in more detail.

FIG. 12 is a flowchart illustrating steps of an automatic playing method according to the present invention. As shown therein, the steps of the automatic playing method of the present invention includes: determining whether or not it is an automatic play mode (SB1); performing a corresponding key function (SB2) and completing the process, if it is not the automatic play mode, and initializing the on-screen display RAM 203D and reading the on-screen information therein (SB3), if it is the automatic play mode; setting an address of the corresponding tune (SB4); reading the scale data (SB5); determining whether the read scale data are identical to the previous data (SB6); if not identical, setting a sound pulse signal generating value for thereby updating a color of the on-screen display RAM 203D for the keyboard representation and the scale data stored in the on-screen RAM (SB7); outputting the corresponding sound (SB8); if it is determined that read scale data are identical to the previous data in the step (SB6), directly outputting the corresponding sound (SB8); increasing the address of the corresponding tune by '1' (SB9); determining whether the increased address is the last data (SB10); returning to the step (SB5), if not the last data, and turning off the on-screen display (SB11) and completing the process, if the last data.

FIG. 13 is a flowchart illustrating steps for chord generation in performing an automatic performance according to the present invention. As shown therein, in a step (SC11) it is determined whether or not there is a chord generating requirement.

If it is no requirement made, the apparatus according to the present invention performs a corresponding function, and if there is the requirement, chord generation data with respect to the corresponding play sound are read from the scale storing device 203F so that a chord generating data value is set (SC2), chord duration data with respect to the corresponding play sound are read from the chord duration storing device 203J so that the read chord duration data are set as a chord duration (SC3), then the chord generation TM is enabled (SC4) and it is determined whether or not there is an interrupt signal from the chord generation TM (SC5). Here, if there is the interrupt signal from the chord generation TM, the present chord generation state is checked (SC6) and then it is checked whether or not the present chord generation state is a high potential state (SC7). If the present state is the high potential state, a 'low' sound is outputted (SC8), whereas if it is a low potential state, a 'high' sound is outputted (SC9). In the above step (SC5), when it is determined that there is no interrupt signal, it is checked whether or not the chord duration is zero (SC10). If the chord duration is zero, the chord generation TM is disabled (SC12) and if not, the chord duration is decreased (SC11) and the process is returned to the step (SC5).

As described above, according to the present invention, the keyboard representation which corresponds to the selected playing sound can be displayed and also various playing sounds and melodies can be generated using the microcomputer and the timer in the user's playing or the automatic playing mode, without using a separate sound source integrating device as in the conventional art, thus providing various sound services, such as the playing function, the automatic accompaniment function, etc., at a relatively low cost.

It will be apparent to those skilled in the art that various modifications and variations can be made in the playing sound generating apparatus and method for the TV set of the present invention without departing from the spirit or scope of the invention. Thus, it is intended that the present invention cover the modifications and variations of this invention provided they come within the scope of the appended claims and their equivalents.

What is claimed is:

1. A playing sound generating apparatus which is integrated with an image display apparatus such as a TV set, comprising:

a remote controller outputting key signal to command generation of a specific sound;

a unit sound data storage for storing pulse generating data with respect to a plurality of unit sounds;

a timer that generates an interrupt signal;

a control for setting an interrupt generating time of the timer in accordance with the corresponding unit sound pulse signal generating data stored in said unit sound data storage when there is a sound generating requirement and checking an output state of a present sound pulse signal whenever the interrupt signal is outputted from the timer and inverting the outputted sound pulse signal;

the timer being effective for counting an oscillating signal of a certain frequency outputted by a frequency divider if the interrupt generating die is set by said control and thereby outputting the interrupt signal to said control whenever said oscillating signal reaches a set count value; and a waveform patterning unit for receiving said sound pulse signal from said control and patterning a waveform thereof.

2. The playing sound generating apparatus according to claim 1, wherein the pulse generating data stored in said unit sound data storage includes scale data, twelve-tone system data of oriental music and beep sound data.

3. A playing sound generating apparatus, comprising;

a continuous sound data storage for storing pulse generating data with respect to a plurality of continuous unit sounds;

a sound duration data storage for storing data for setting a duration of each sound to be generated;

a control for setting a unit sound pulse signal generating timer with pulse generating data values of a corresponding unit sound stored in said continuous sound data storage and setting a sound duration controlling timer with sound duration data stored in said sound duration data storage when there is a continuous sound generating requirement, and then continuously generating sound pulse signals of a corresponding duration by inverting a state of a present sound pulse signal whenever an interrupt signal is outputted from said unit sound pulse generating timer and disabling the unit sound pulse generating timer when a value of the sound duration data becomes zero upon being decreased by 1 whenever the interrupt signal is outputted from the timer, and a waveform patterning unit for receiving a sound pulse signal from said control and patterning a waveform thereof.

4. The playing sound generating apparatus according to claim 3, wherein said unit sound pulse signal generating timer counts an oscillating signal of a certain frequency after an interrupt generating time is set by said control means in accordance with a pulse generating data value of the corresponding sound and outputs the interrupt signal to said control means whenever said oscillating signal reaches a set count value.

5. The playing sound generating apparatus according to claim 3, wherein said sound duration controlling timer counts an oscillating signal of a certain frequency after an interrupt generating time is set by said control means in accordance with a pulse generating data value of the corresponding sound and outputs the interrupt signal to said control means whenever said oscillating signal reaches a set count value.

6. A playing sound generating apparatus, comprising:

a unit sound data storing means for storing pulse generating data of a plurality of unit sounds;

a sound duration data storing means for storing data for setting a duration of each sound to be generated;

a melody data storing means for storing data for generating a plurality of continuous melody sounds;

a control means for reading data from said sound duration data storing means and melody data storing means when there is a melody generation requirement, setting a unit sound pulse signal generating timer and a sound duration controlling timer in accordance with respective values of the read data and generating continuous pulse signals with respect to the corresponding melody in response to interrupt signals which are outputted from said unit sound pulse generating and sound duration controlling timers; and a waveform patterning unit for patterning waveforms of the melody pulses outputted from said control means.

7. A playing sound generating method, comprising the steps of:

reading a pulse generating data value for generating a corresponding unit sound from a unit sound data storage when there is a sound generating requirement, for thereby setting a unit sound pulse signal generating timer to the read pulse generating data value;

outputting an interrupt signal whenever a counted output signal of a frequency divider reaches a set pulse generating data value;

inverting a present sound pulse signal output state whenever the interrupt signal is outputted from the unit sound pulse signal generating timer, and checking whether a previously set sound pulse signal output time is reached and repeatedly performing the above steps until a sound pulse signal output time is reached/elapsed.

8. A playing sound generating method, comprising the steps of:

reading corresponding data from a continuous sound data storing means when there is a continuous sound generating requirement, for thereby setting a pulse generating value corresponding to the read data in an internal RAM for setting an interrupt generating time of a continuous sound pulse signal generating timer;

reading a sound duration value of the corresponding sound from a sound duration data storing means and setting a sound duration pulse generating value in a continuous sound pulse signal generating timer after storing the sound duration value in the internal RAM;

inverting a present sound pulse signal output state whenever an interrupt signal is outputted from the continuous sound pulse signal generating timer; and decreasing the sound duration value by 1 whenever the interrupt signal is outputted from the continuous sound pulse signal generating timer and disabling the continuous sound pulse signal generating timer in case the sound duration value become zero.

9. A playing sound generating method, comprising the steps of:

setting a data location for generating a melody when there is a melody generation requirement and setting a continuous sound mode by reading data from a melody data storing means;

setting an internal sound duration value by reading data from a sound duration data storing means in accordance with a value of the set data location and enabling a continuous sound pulse signal generating timer after setting a present mode as the continuous sound mode;

generating a melody pulse signal using an interrupt signal outputted from the continuous sound pulse signal generating timer and setting a duration of said melody pulse by decreasing the sound duration value by 1 whenever the interrupt signal outputted from the continuous sound duration controlling timer until the sound duration value becomes zero;

increasing an address of the continuous sound data location by 1 when the sound duration value reaches zero; and repeating the above steps by sequentially reading data for generating the melody and completing the melody generating operation when an end code of the read data is detected.

* * * * *